US006276689B1

(12) United States Patent
Brown

(10) Patent No.: US 6,276,689 B1
(45) Date of Patent: Aug. 21, 2001

(54) COMBINED POOL AND POKER GAMBLING GAME

(76) Inventor: Jack Brown, 760 Main St., Kalispell, MT (US) 59901

( * ) Notice: Subject to any disclaimer, the term of this patent is extended or adjusted under 35 U.S.C. 154(b) by 0 days.

(21) Appl. No.: 09/524,420

(22) Filed: Mar. 11, 2000

(51) Int. Cl.[7] ..... A63F 1/00

(52) U.S. Cl. ..... 273/292; 273/236; 273/274; 463/13; 473/1

(58) Field of Search ..... 273/292, 274, 273/FOR 236, 244.2; 473/1; 463/13

(56) References Cited

U.S. PATENT DOCUMENTS 3,877,699 * 4/1975 Reiner .
4,002,339 * 1/1977 Reiner .
4,840,376 * 6/1989 Garret .
4,878,664 * 11/1989 Brookes .
4,948,128 * 8/1990 Emery, II .
5,372,366 * 12/1994 Gohike .
5,830,063 * 11/1998 Byrne .

* cited by examiner

*Primary Examiner*—Benjamin H. Layno
(74) *Attorney, Agent, or Firm*—Burkhart & Burkhart; Anne K. Burkhart; Patrick N. Burkhart

(57) ABSTRACT

A method of playing a gambling game involving two or more players. In a first step, the players agree on a unit of betting. Once the unit has been set, each player antes one betting unit. A standard five-card poker hand is dealt for each player, and one pea is distributed per hand. At this point, the players are permitted to see their hands and peas. If the number on the player's pea corresponds to one or more cards in the player's hand (ace+1 ball, deuce=2 ball, etc.). If not, the player returns the pea to the shaker. If the pea corresponds to one or more cards in the player's hand, the pea is retained. The order of play is determined in any suitable manner. Shooting begins when the first player "breaks the rack". If a ball is not made, the shooter changes. If the shooter has scratched, he adds one unit of betting to the pot in addition to giving up his turn. If a ball is made, the shooter checks to determine if he has made, i.e., the ball whose number corresponds to the pea and one or more of his cards. The shooter reveals the pea and corresponding cards, and the players ante into the pot corresponding to the number of cards plus the pea. Next, each player determines whether or not the made ball has completed his hand. If so, that player is declared the winner, and takes the pot. If not, the shooter continues until a winner is declared.

10 Claims, 2 Drawing Sheets

COMBINED POOL AND POKER GAMBLING GAME

FIELD OF THE INVENTION

The present invention relates generally to games of chance and skill. Specifically, the present invention relates to games combining elements of pool and poker with other wagering elements.

BACKGROUND OF THE INVENTION

The games of poker and pool have provided countless hours of entertainment to generations of players. Almost every variation of pool or billiards requires concentration, skill, and nerve. Excellence at poker results from a keen sense of applied psychology, combined with an element of chance. Both games regularly reward their players with drama, humor, and camaraderie with their fellows.

It is not surprising that there have been many attempts to combine various aspects of poker and pool into a single game. One example of such an attempt is illustrated in U.S. Pat. No. 4,878,664 to Brookes. In this patent, a pool game uses balls marked to correspond to standard playing cards. Each player or team attempts to form a "poker hand" by sinking appropriate balls, to defeat the opponent's hand. Typically, an electronic scoring apparatus detects each ball as it is potted, and displays the state of each player's "hand".

U.S. Pat. No. 4,840,376 to Garret is directed to a poker game used with a pool table. A plurality of balls, each ball marked with the face and suit of a card, corresponds to representations of the cards on a wall mounted scoreboard, the scoreboard carrying the same card markings for each player. A pushbutton under each card is manually operable to light up an individual indicated card when the corresponding ball is sunk on the pool table. A micro-processor is operable to determine the highest scoring "hand" of each player.

U.S. Pat. No. 4,948,128 to Emery et al. discusses a pool table designed to allow various poker games to be played using card values visibly marked on the balls and/or using plain unmarked balls. The plain unmarked balls have a unique electric name tag encoded therein which is read by an electronic reader system mounted beneath the table top. A ball mixing assembly is also mounted below the table top and there is structure for delivering specific or random pool balls upwardly through any of the various pockets of the table where they are then ejected onto the top of the table itself. An electronic circuit is connected to a computer which controls the instructions that are delivered to the various mechanical assemblies so that a variety of poker games may be played. A visual or private display is also connected to the computer to record the poker hands that are being obtained by each player.

U.S. Pat. No. 5,830,063 to Byrne illustrates a gambling game in which a collateral gambling game which can be won by players on at least one specific event occurring in the principal game, the collateral game being separate from the principal game but one when any of the possible winning events occur in the principal game, the payment to the player being calculated from the total value available for the game divided by the total number of players who bet on the specific winning event. The game gives a possibility for a large number of players to share in the success of a single player who has successfully won the main game. It may be used with various types of games including those using electronic gaming machines.

Despite their advantages, known poker/pool either fail to capture the desirable aspects of the respective games, or require relatively complex, specialized apparatus to play.

It can thus be seen that the need exists for a simple, fun-to-play poker pool game that retains the best aspects of poker and of pool, without requiring complex or expensive game apparatus.

SUMMARY OF THE INVENTION

These and other objects are achieved by providing a method of playing a gambling game involving two or more players. In a first step, the players agree on a unit of betting, for example, a monetary unit such as a quarter, or a symbolic unit such as a certain colored chip. Once the unit has been set, each player antes one betting unit. A standard five-card poker hand is dealt for each player, and one pea is distributed per hand. At this point, the players are permitted to see their hands and peas. If the number on the player's pea corresponds to one or more cards in the player's hand (ace+1 ball, deuce=2 ball, etc.). If not, the player returns the pea to the shaker. If the pea corresponds to one or more cards in the player's hand, the pea is retained for purposes that will be described below.

The order of play is determined in any suitable manner, such as cutting cards, etc. This initial order is retained throughout the game. Shooting begins when the first player "breaks the rack". If a ball is not made, the shooter changes. If the shooter has scratched, he adds one unit of betting to the pot in addition to giving up his turn.

If a ball is made, the shooter checks to determine if the he has made his "pea ball", i.e., the ball whose number corresponds to the pea and one or more cards in the player's hand. If a pea ball has been made, the shooter reveals the pea and corresponding cards, and the players ante into the pot a number of betting units corresponding to the number of cards plus the pea. For example, if the shooter holds a pair of fives and a number five pea, then makes the five ball, each player must ante three betting units into the pot. If the shooter has the number 14 or 15 pea and makes the 14 or 15 ball, each player antes one betting unit into the pot. The 16 pea is "wild", and can be applied to any card value in the player's hand. For example, if the shooter holds a three fives and a number sixteen pea, then makes the five ball, each player must contribute three betting units into the pot, one for each five held.

Next, the each player determines whether or not the made ball has completed his hand, putting the player out. If so, that player is declared the winner, and takes the pot. If not, play returns to the shooting step, and the shooter continues until a winner is determined.

The foregoing will become apparent to one of ordinary skill in the art when taken into consideration with the following detailed description in conjunction with the following drawings, in which:

DETAILED DESCRIPTION OF THE INVENTION

Figure 1:
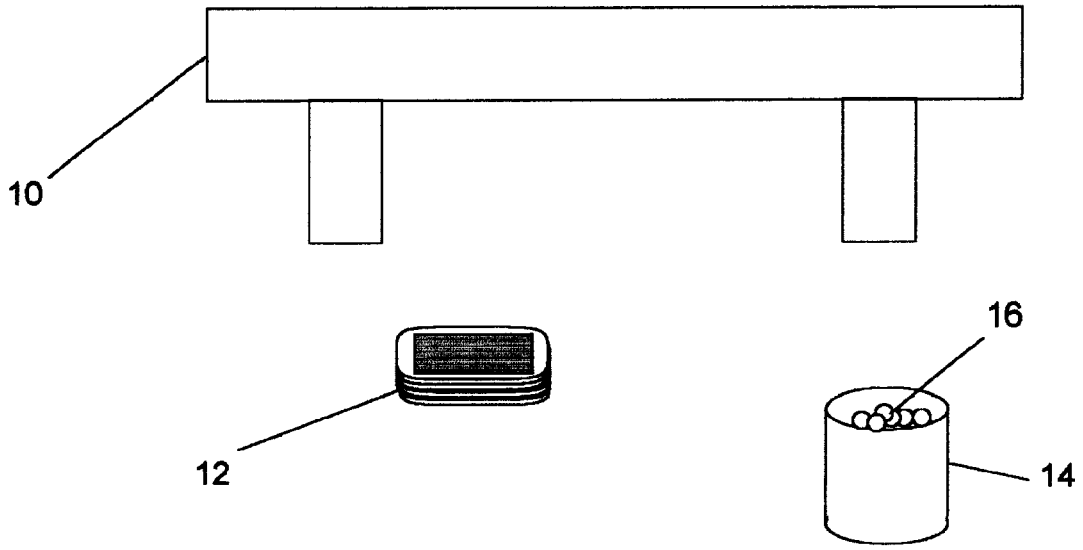
FIG. 1 illustrates a schematic view of apparatus required in playing a game in accordance with the principles of the present invention.

The equipment required for playing the game of the present invention is illustrated in FIG. 1. All that is needed is: a standard pool table set 10, including 16 standard billiard balls: a standard deck 12 including 52 playing cards; and a shaker 14 containing 16 "peas" or markers 16, the peas being individually numbered from 1 to 16.

Up to nine players can participate in a game using a standard deck of cards. However, it has been found that a game played with 4 or 5 players provides an exciting game pace while still building sizable pots.

The object of the game is for all of the balls corresponding to the cards in the player's hand to be or "made", that is, successfully shot into a pocket of the pool table. The first player to have all of the balls corresponding to the cards in that player's hand made wins the game, and the pot.

Figure 2:
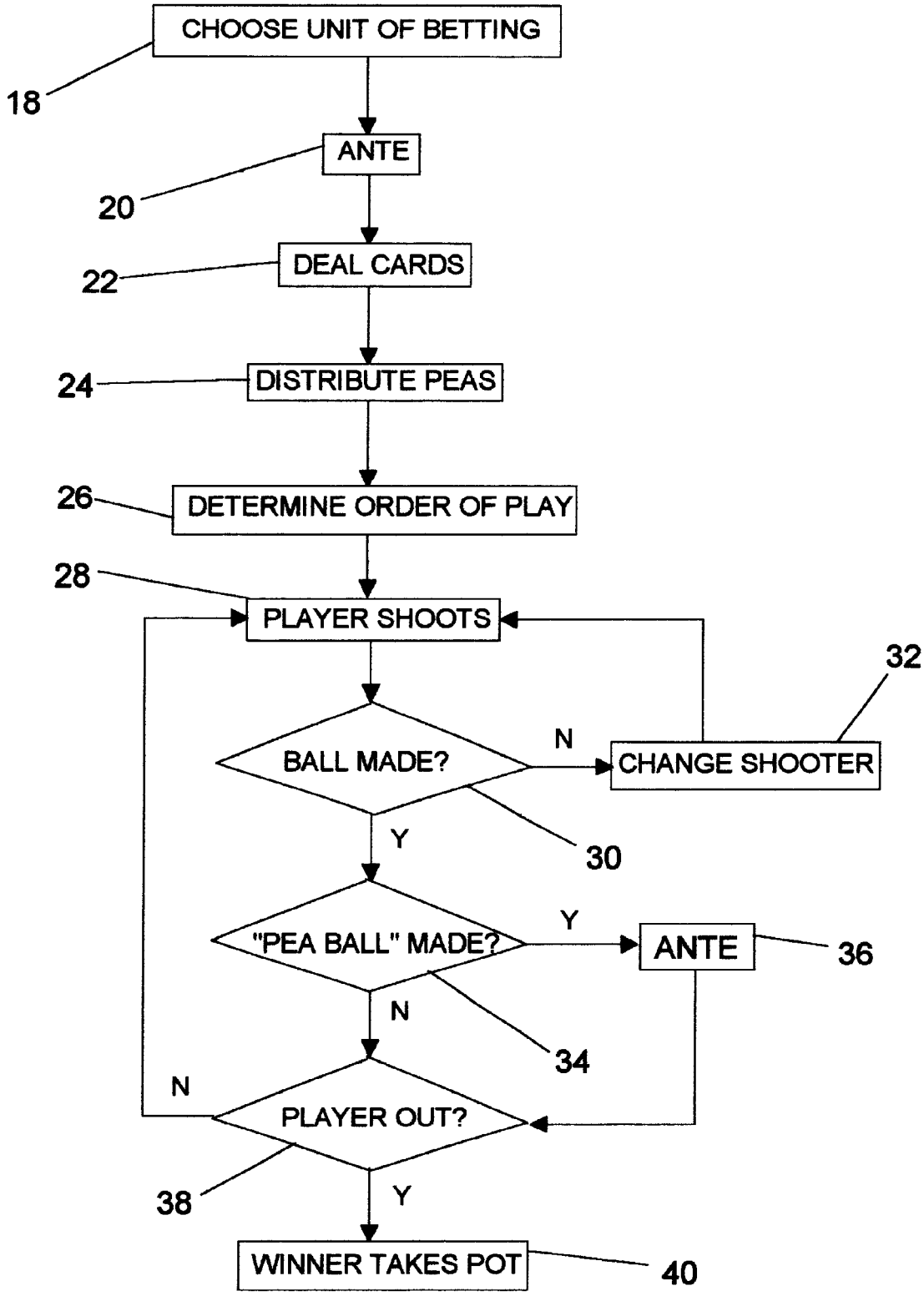
FIG. 2 illustrates a flow chart of exemplary steps required in playing a game in accordance with the principles of the present invention.

The basic steps for playing the game are set forth in FIG. 2. First, at point 18, the players agree on a unit of betting, for example, a monetary unit such as a quarter, or a symbolic unit such as a certain colored chip. Once the unit has been set, each player antes one betting unit at point 20. A standard five-card poker hand is dealt for each player at point 22, and one pea is distributed per hand at point 24. At this point, the players are permitted to see their hands and peas. If the number on the player's pea corresponds to one or more cards in the player's hand (ace+1 ball, deuce=2 ball, etc.). If not, the player returns the pea to the shaker 14. If the pea corresponds to one or more cards in the player's hand, the pea is retained for purposes that will be described below.

The order of play is determined at point 26 in any suitable manner, such as cutting cards, etc. This initial order is retained throughout the game. Shooting begins at point 28 where the first player "breaks the rack". If a ball is not made at point 30, the shooter changes at point 32, and play returns to point 28. If the shooter has scratched, he adds one unit of betting to the pot in addition to giving up his turn.

If a ball is made at point 30, the shooter checks to determine if the he has made his "pea ball", i.e., the ball whose number corresponds to the pea and one or more cards in the player's hand. If a pea ball has been made, the shooter reveals the pea and corresponding cards, and the players ante into the pot a number of betting units corresponding to the number of cards plus the pea. For example, if the shooter holds a pair of fives and a number five pea, then makes the five ball, each player must ante three betting units into the pot. If the shooter has the number 14 or 15 pea and makes the 14 or 15 ball, each player antes one betting unit into the pot. The 16 pea is "wild", and can be applied to any card value in the player's hand. For example, if the shooter holds a three fives and a number sixteen pea, then makes the five ball, each player must contribute three betting units into the pot, one for each five held.

Next, the each player determines whether or not the made ball has completed his hand at point 38, putting the player out. If so, that player is declared the winner, and takes the pot at point at point 40. If not, play returns to point 28, and the shooter continues.

It does not matter whether the balls are made by the player himself, or by other players. The first player to have all balls corresponding to the cards in that player's hand made wins the game, irrespective of whether that player is the shooter at the time the last ball is made. If the shooter and one or more other players go out on the same shot, the shooter wins irrespective of the value of his hand. If two or more non-shooters go out on the same shot, the player holding the best poker hand wins.

Several variations can be played in the context of the above-stated rules. For example, players winning consecutive games can be handicapped by being required to take six cards for the next hand. If a player continues to win, he takes an additional card for each game, i.e., three games=seven cards, etc. Should the player so handicapped need a tie-breaker to end the game (when two or more non-shooters go mouton the same shot), he may use any five cards in his hand.

In another variation, an extra hand and pea can be dealt at the beginning of the game, with the second shooter having the option of "buying" the hand and pea with an additional ante of one betting unit to the pot. If the second shooter declines the extra hand, the "right of refusal" passes to subsequent shooters serially.

Another variation uses a "common pea" turned face up at the beginning of the game. If a shooter has a card or cards in his hand corresponding to the common pea, and makes the ball corresponding to the common pea, the other players pay one betting unit directly to the shooter for each corresponding card, rather than to the pot. In racking the balls, the "common pea" ball is racked in the center, next to the 14 and 15 balls.

In another version, two sets of peas are used. Thus, if a shooter has a card or cards in his hand corresponding to the pea dealt to him and to the common pea, and makes the ball corresponding numbered ball, the other players pay one betting unit directly to the shooter, and one betting unit to the pot, for each corresponding card.

Another variation penalizes players for failing to turn in their hands at the end of a game by requiring them to play two hands (10 cards) in the subsequent game. This encourages speedy play and prompt return of cards.

In another variation, bets and/or cards dealt can be doubles the last half hour of the game. In a further version, all "scratch" antes can be placed in a separate "refreshment" pot.

It can thus be seen that the present invention provides a fast-paced, simple game combining the best elements of pool and poker, while adding additional betting elements. The game involves chance, strategy, and skill while tending to equalize the likelihood of winning for all skill levels. Once some proficiency at the game has been acquired, deliberate bluffing, misdirection, and deception can be employed.

Although the present invention has been described with reference to specific embodiments, those of skill in the art will recognize that changes may be made thereto without departing from the scope and spirit of the invention as defined by the appended claims.

What is claimed is:

1. A method of playing a betting game for two or more players, the method comprising the following steps:

providing a standard pool table, a plurality of numbered billiard balls, and at least one cue stick;

providing a standard deck of 52 cards;

providing a plurality of numbered peas corresponding in number and designation to the plurality of billiard balls;

determining a unit of betting contributing one betting unit per player to a common winnings pot;

dealing a standard five-card poker hand is dealt for each player;

distributing one pea for each hand dealt;

retaining the respective pea if the respective pea corresponds to one or more cards in the respective dealt hand;

discarding the respective pea if the respective pea does not correspond to one or more cards in the respective dealt hand;

determining an order of play;

allowing a first player to rack and break the billiard balls;

allowing a second player to shoot of the first player fails to make a ball;

determining if a ball whose number corresponds to shooting player's pea and one or more cards in the shooting player's hand has been made;

revealing the pea and corresponding cards, and causing the players to ante into the pot a number of betting units corresponding to the number of cards plus the pea, when a ball whose number corresponds to shooting player's pea and one or more cards in the shooting player's hand has been made;

determining whether or not the all of the balls corresponding to the cards in one or more player's hand has been made;

declaring a player the winner of the game if all of the balls corresponding to the cards in that player's hand have been made;

allowing the current shooting player to continue shooting if all of the balls corresponding to the cards in one or more player's hand has not been made; and returning to the step of determining if a ball whose number corresponds to shooting player's pea, and repeating the subsequent steps, until all of the balls corresponding to the cards in one or more player's hand has been made.

2. A method in accordance with claim 1, further comprising the step of requiring a player to contribute one unit of betting into the pot if the player scratches.

3. A method in accordance with claim 1, further comprising the step of handicapping players winning consecutive games can be handicapped by being required to take additional cards for subsequent games.

4. A method in accordance with claim 1, further comprising the following steps:

dealing an extra hand and pea at the beginning of the game; and allowing the second player to have and option of buying the hand and pea with an additional ante of one betting unit to the pot.

5. A method in accordance with claim 4, further comprising the step of allowing subsequent players the option of buying the extra hand if the second shooter declines the extra hand.

6. A method in accordance with claim 1, further comprising the following steps:

dealing an extra, common pea at the beginning of the game; and causing the players to pay one betting unit directly to the shooter if a shooter has a card or cards in his hand corresponding to the common pea, and makes the ball corresponding to the common pea.

7. A method in accordance with claim 6, further comprising the following steps:

providing an additional set of peas;

causing the players to pay one betting unit directly to the shooter, and one betting unit to the pot, for each corresponding card, when a shooter has a card or cards in his hand corresponding to the pea dealt to him and to the common pea, and makes the ball corresponding numbered ball.

8. A method in accordance with claim 1, further comprising the step of penalizing players for failing to turn in their hands at the end of a game by requiring them to play two hands in the subsequent game.

9. A method in accordance with claim 1, further comprising the following steps:

setting a time limit on the duration of the game; and doubling the amount of betting units per event during a predetermined final period of the game.

10. A method in accordance with claim 1, further comprising the following steps:

setting a time limit on the duration of the game; and doubling the amount of cards dealt per hand during a predetermined final period of the game.

* * * * *